US006844856B1

(12) United States Patent
Wright

(10) Patent No.: US 6,844,856 B1
(45) Date of Patent: Jan. 18, 2005

(54) MINIMUM CYCLE SLIP AIRBORNE DIFFERENTIAL CARRIER PHASE GPS ANTENNA

(75) Inventor: Charles Wayne Wright, Salisbury, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 5 days.

(21) Appl. No.: 10/615,364

(22) Filed: Jul. 8, 2003

(51) Int. Cl.[7] ..... H01Q 1/28

(52) U.S. Cl. ..... 343/705; 343/708; 343/766; 342/357.06; 342/359

(58) Field of Search ..... 343/705, 708, 343/865, 866, 872; 342/37, 38, 359, 357.06, 360; 701/213, 214

(56) References Cited

U.S. PATENT DOCUMENTS

| | | | | | |
|---|---|---|---|---|---|
| 4,593,288 | A | * | 6/1986 | Fitzpatrick | 343/705 |
| 4,691,207 | A | | 9/1987 | Timineri | 343/766 |
| 4,746,082 | A | * | 5/1988 | Syms et al. | 244/137.4 |
| 4,910,526 | A | * | 3/1990 | Donnangelo et al. | 342/455 |
| 5,075,694 | A | * | 12/1991 | Donnangelo et al. | 342/455 |
| 5,185,610 | A | | 2/1993 | Ward et al. | 342/357.11 |
| 5,228,854 | A | * | 7/1993 | Eldridge | 434/11 |
| 5,347,286 | A | | 9/1994 | Babitch | 342/359 |
| 5,371,508 | A | * | 12/1994 | Teich et al. | 343/703 |
| 5,389,940 | A | * | 2/1995 | Sutherland | 343/765 |
| 5,570,097 | A | | 10/1996 | Aguado | 342/357.06 |
| 5,734,348 | A | | 3/1998 | Aoki et al. | 342/357.17 |
| 5,777,578 | A | | 7/1998 | Chang et al. | 342/357.06 |
| 5,912,642 | A | | 6/1999 | Coffin et al. | 342/359 |
| 6,166,683 | A | | 12/2000 | Hwang | 342/357.04 |
| 6,175,806 | B1 | | 1/2001 | Thuente | 701/213 |
| 6,205,400 | B1 | | 3/2001 | Lin | 701/214 |
| 6,342,853 | B1 | | 1/2002 | Kalafus et al. | 342/357.03 |
| 2003/0071758 | A1 | * | 4/2003 | Bien et al. | 343/757 |
| 2003/0117327 | A1 | * | 6/2003 | Navarro et al. | 343/705 |

* cited by examiner

*Primary Examiner*—Tan Ho
(74) *Attorney, Agent, or Firm*—Keith Dixon

(57) ABSTRACT

An antenna system is disclosed including a GPS antenna which is driven by an articulator in an opposite direction to aircraft roll. Aircraft roll is sensed by an onboard navigation system and translation module sends a signal to a processor which provides a drive signal to the articulator. As the aircraft rolls in one direction, the antenna is driven oppositely to maintain the vertical orientation of the antenna.

20 Claims, 3 Drawing Sheets

MINIMUM CYCLE SLIP AIRBORNE DIFFERENTIAL CARRIER PHASE GPS ANTENNA

ORIGIN OF THE INVENTION

The invention described herein was made by an employee of the United States Government and may be manufactured and used by or for the Government for governmental purposes without the payment of any royalties thereon or therefore.

FIELD OF THE INVENTION

This invention relates to an airborne antenna system, and more specifically, to a GPS (global positioning system) antenna orientation device for use with airplanes.

DETAILED DESCRIPTION OF THE PRIOR ART

In conducting airborne GPS surveying operations, it is important for the surveying equipment to be provided with their precise geographic location.

The global positioning system can be used to determine the position of a GPS antenna to within a few centimeters by using well developed carrier phase differential interferometric techniques between an aircraft mounted GPS antenna and a nearby surveyed GPS reference receiver. The satellites participating in determining each fix must be widely distributed in azimuth and elevation to achieve optimum geometry when computing each fix.

The GPS satellites are in orbit around the Earth which causes each of them to rise and set relative to the horizon. It is critically important that each satellite be visible and its carrier signal and phase be tracked by both the aircraft and the ground reference station. The carrier signal and phase information is lost or adversely affected by aircraft orientation during banking maneuvers which cause the aircraft GPS antenna to be pointed in an unfavorable direction for some satellites. Loss of carrier signal or phase information from a satellite is termed a "cycle slip." A cycle slip can occur by losing signal for as little as 1 billionth ($1.0\times10\ e^{-9}$) of a second. Longer periods of missing signal cause loss of multiple cycles.

GPS antenna are normally securely mounted to the aircraft and are not moveable relative to the aircraft. Accordingly, during maneuvering of the aircraft, cycle slips may occur. Principal factors which cause cycle slips in an airborne environment are: 1) reduced signal due to unfavorable antenna orientation, 2) the path between the antenna and satellite is blocked by aircraft structure (wing, etc.), 3) the signal arrives directly from the satellite and via reflection from nearby parts of the aircraft and the direct and reflected signals are equal amplitude and opposite in phase causing them to cancel each other.

A need exists to reduce cycle slips caused by weak signals which are introduced by the GPS antenna being oriented in a less than optimal way since a maneuvering aircraft will necessarily be rolling, pitching or yawing so that the antenna is not vertically oriented.

Traditionally, pilots are instructed to reduce the banking (i.e., turning) of the aircraft to 10 degrees or less in order to minimize cycle slips during surveying operations. While this method may work, it significantly reduces the maneuverability of the aircraft and may result in a large amount of time necessary in order for the pilot to reverse course to continue with the surveying operation. For instance, for closely spaced survey flight lines, a turn called a 90–270 is typically employed. The 90–270 requires a total of 360 degrees of heading change to effect a course reversal. If a 30 degree bank required two minutes to complete, then a 10 degree limited bank would require approximately six minutes to complete.

As an example, considering surveying an area 5 kilometers by 5 kilometers with a remote sensing system which has a swath of approximately 240 meters. To cover this area with flight lines every 200 meters would require 5000/200 or 25 total flight lines. A nominal survey speed of 3600 meters per minutes each flight line requires one minute and 24 seconds to cover for a total of approximately 35 minutes of flight. 24 turns will be required to occupy all the flight lines. If those turns are 30 degrees each and take two minutes to perform, the total required flight time will be 24*2+35 or 1 hour and 23 minutes. If the turns were restricted to 10 degrees, then the required flight time would be 24*6+35 or approximately 3 hours. In this example, more time would be spent maneuvering then surveying.

Accordingly, a need exists to provide for the ability to perform sharper turns in aircraft without losing the GPS fix.

SUMMARY OF THE INVENTION

The present invention is directed to an antenna system for an aircraft for use with a global positioning system comprising: an aircraft having an aircraft attitude determination system providing attitude data relating to aircraft roll, a translation module connected to the aircraft attitude determination system receiving the attitude data and outputting output data, a processor receiving the output data from the translation module and providing a drive signal, a controller receiving the drive signal from the processor an articulator driven by the controller, and antenna attached to the articulator driven by the controller oppositely to the aircraft roll.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
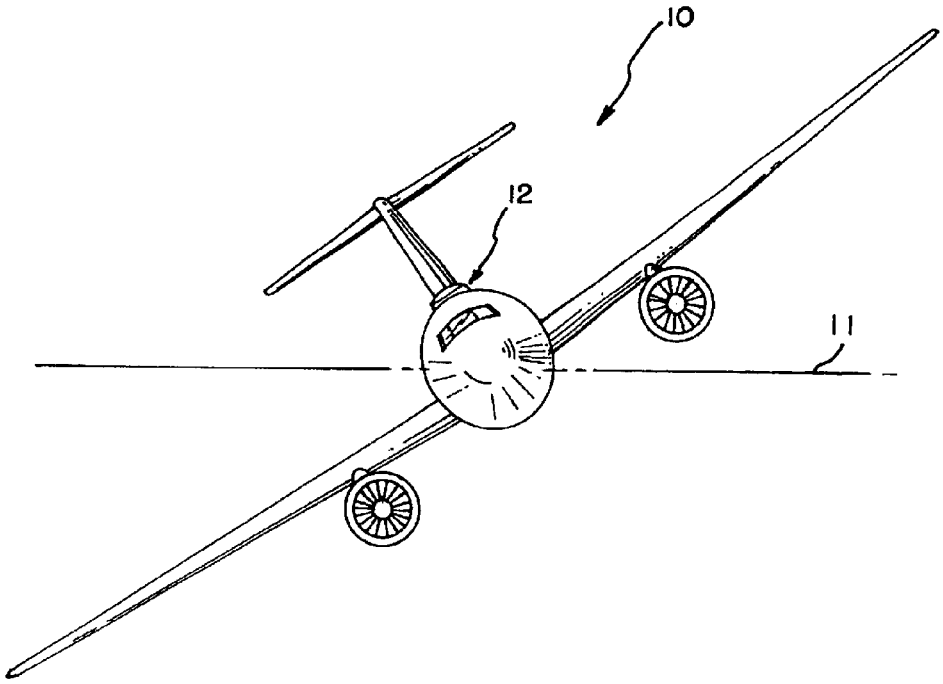
FIG. 1 is a front plan view of an aircraft equipped with an antenna system in accordance with the present invention banked at an angle of about 45° to a horizon.
Figure 2:
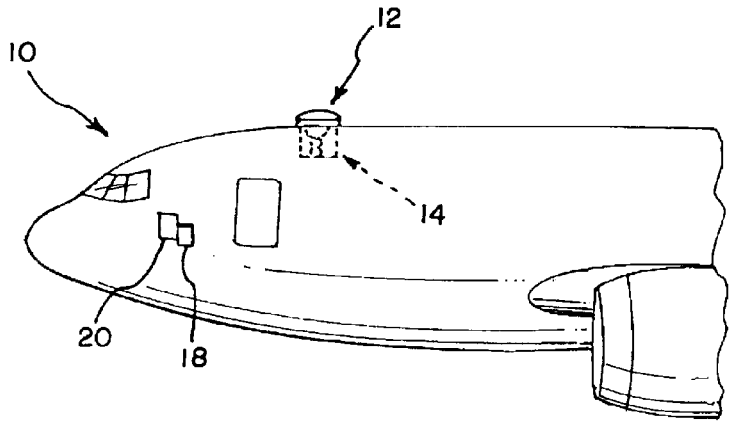
FIG. 2 is a side perspective view of a portion of an airplane with the antenna mounted thereon.
Figure 4:
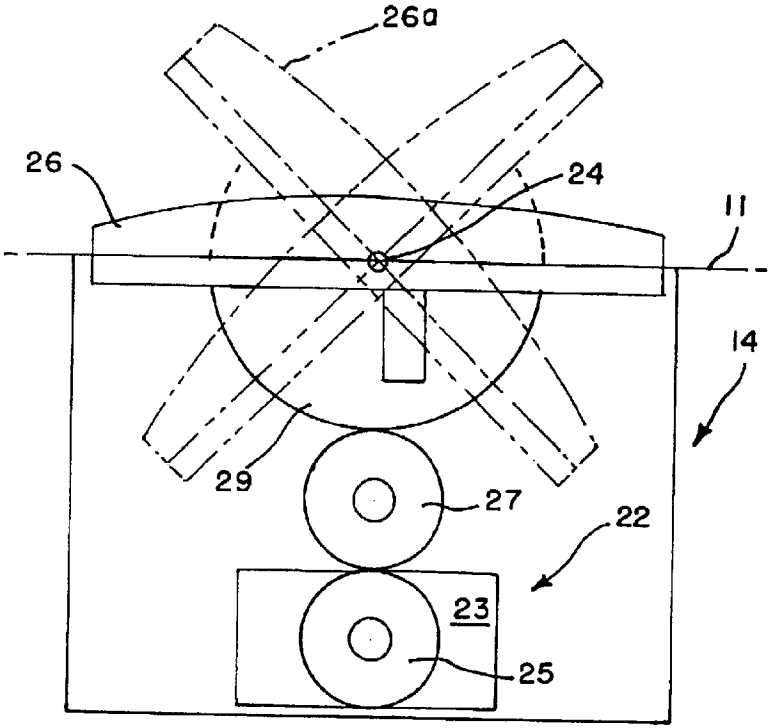
FIG. 4 is a side cross-sectional view of the antenna mount shown in FIG. 3.
Figure 3:
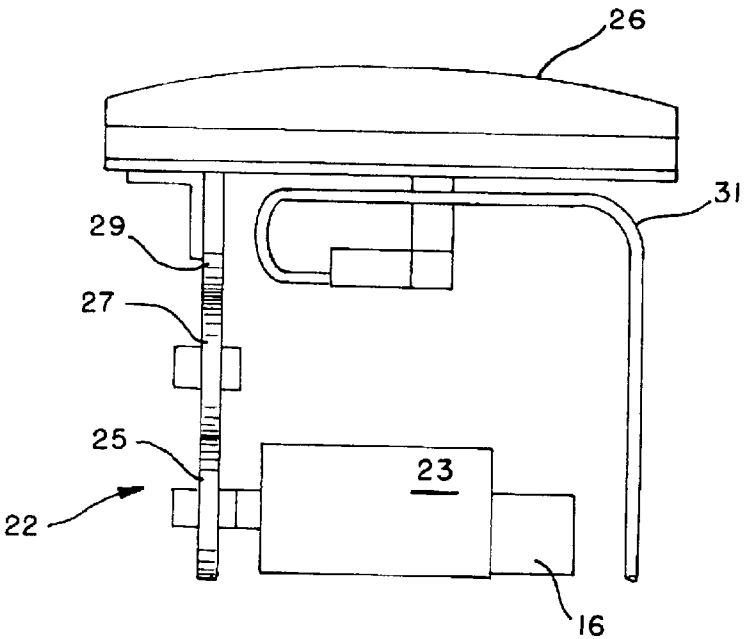
FIG. 3 is a front cross-sectional view of the antenna mount utilized in the preferred embodiment of the antenna system.

FIG. 1 shows a front view of an airplane 10 equipped with the preferred embodiment of an antenna system of the present invention which is shown in more detail in FIGS. 2–4.

Figure 2A:
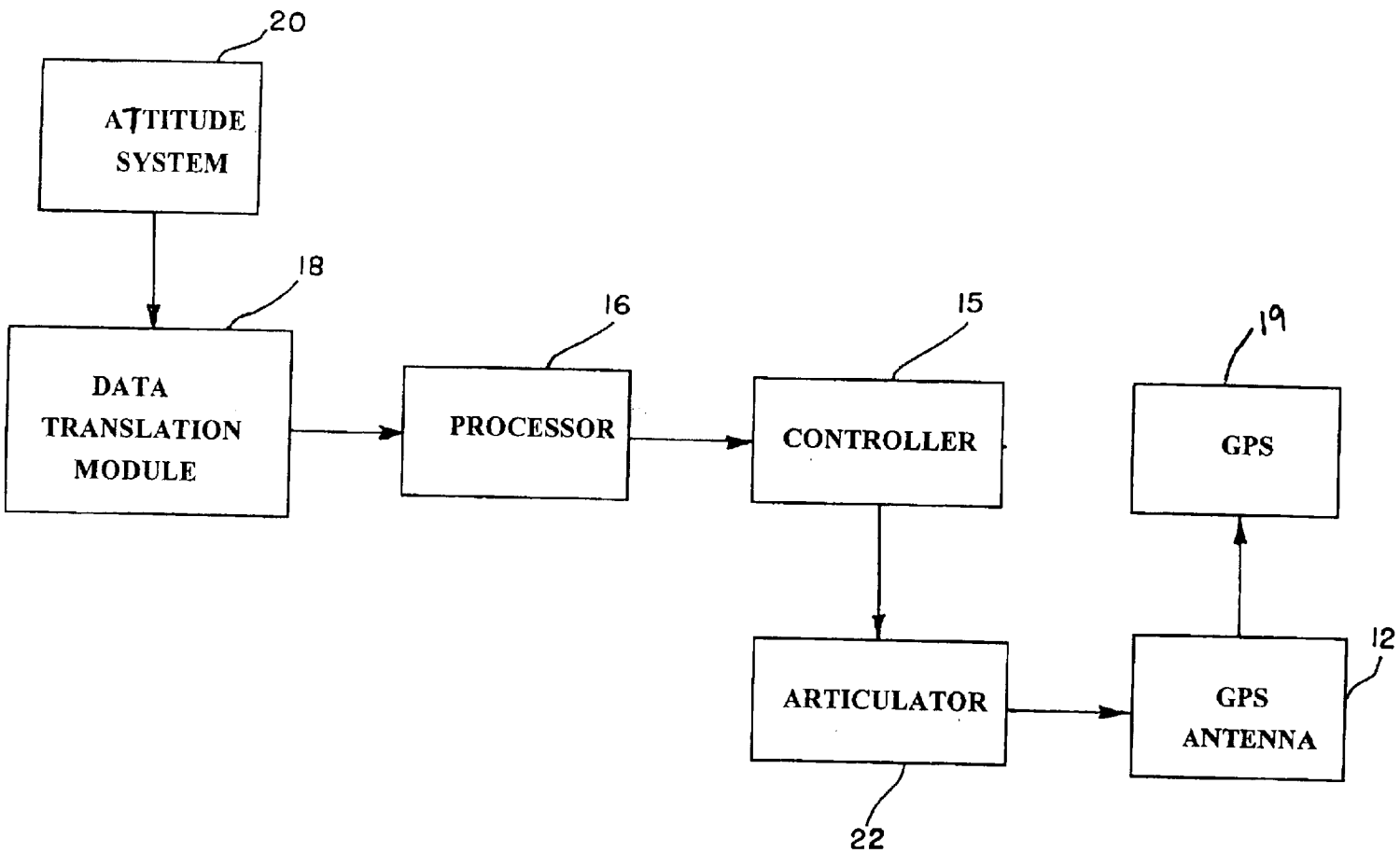
FIG. 2*a* is a functional block diagram of the invention.

FIGS. 2 and 2*a* show the front portion of the airplane 10 equipped with an articulating GPS antenna 12 supported by mount 14 which may be partially recessed in the fuselage as shown or otherwise installed on airplane 10. A processor 16 in the form of a microprocessor based interface circuitry receives a signal from a data translation module 18 shown in FIG. 2*a*. The data translation module 18 receives a signal from an aircraft attitude system 20 such as an aircraft attitude determination system, attitude indicator, and/or navigation system such as an inertial navigation system or otherwise.

The attitude system 20 shown in FIGS. 3 and 4, delivers aircraft roll data such as in the form of digital data or analog synchro data to the processor 16 (i.e., digital or analog data in an appropriate format). The processor 16 receives and decodes the delivered attitude data and provides a signal to the controller 15 which drives the articulator 22 so that the antenna 12 is moved in an opposite direction to the roll of the aircraft sensed by the aircraft sensor 20. This has been found effective to maintain the GPS antenna 12 in a substantially vertical orientation in spite of roll occurring by the airplane 10. Aircraft roll is defined as the angle of rotation of an airplane along its longitude axis relative to the horizon. It is a term known in the art.

The aircraft system 20 and translation module 18 as well as the processor 16 and articulator 22 are driven by the aircraft electrical system. The physical size of the mount 14 in a prototype is about 10×15×15 cm. The mount 14 may weigh about a pound, but after equipping with a radome 26 about two pounds. A range of rotation of approximately at least 45 degrees to counter aircraft roll in either direction has been tested.

In the preferred embodiment the processor 16 receives aircraft attitude information at least five times per second. However faster or slower refresh rates may be also be utilized.

The axis of rotation is centered on pivot 24 so as to pass through the phase center of the actual GPS antenna 12 wherein it introduced no more than a very small error. The attitude information is obtained from the onboard inertial navigation system of the aircraft.

Although a linear motor, such as servo motor 23, may be utilized as shown in FIGS. 3–4, other articulators 22 may be utilized to position the antenna 12 in a vertical orientation. The servo motor 23 drives gears 25,27 which act on gear 29 which is illustrated connected to the bottom of the radome 26. Table 31 is illustrated connected to radome 26 to provide data path to the aircraft 10. Furthermore, the processor 16 or translator 18 may contain a feed back loop to limit hunting and a dead zone such as no movement for a change in idle of about 3–5 degrees may be provided to prevent excessive wear and tear of the articulator 22.

FIG. 1 shows an aircraft with the antenna 12 positioned relative to the aircraft 10 at an aircraft roll position of about 45° relative to the horizon 11. In FIG. 4, the radome 26 is positioned in phantom and illustrated as element 26*a* which is opposite to the direction of roll of the aircraft 10 shown in FIG. 1. As the aircraft 10 rolls one way, the articulator 22 drives the antenna 12 within the radome 26 in an opposite direction to maintain the antenna 12 in an optimum upright orientation.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depend from the spirit of the invention are intended to be included within the scope of the appended claims.

Having thus set forth the nature of the invention, what is claimed herein is:

1. An antenna system for an aircraft for use with a global positioning system comprising:

an aircraft having an aircraft attitude determination system providing attitude data relating to aircraft roll;

a translation module connected to the aircraft attitude determination system receiving the attitude data and outputting output data;

a processor receiving the output data from the translation module and providing a drive signal;

a controller receiving the drive signal from the processor;

an articulator driven by the controller; and antenna attached to the articulator driven by the controller oppositely to the aircraft roll.

2. The antenna system of claim 1 wherein the aircraft attitude determination system is an internal navigation system.

3. The antenna system of claim 1 wherein the antenna is contained within a radome mounted to the airplane.

4. The antenna system of claim 1 wherein the articulator is contained in a mount on an exterior portion of the aircraft.

5. The antenna system of claim 1 wherein the articulator further comprises a linear motor.

6. The antenna system of claim 1 wherein the processor has a feedback loop.

7. The antenna system of claim 1 wherein the antenna is maintained substantially vertical at least up to about forty five degrees of roll of the aircraft.

8. The antenna system of claim 7 wherein the antenna is maintained vertical.

9. The antenna system of claim 1 wherein the translation module provides output data in one of digital and analog data.

10. An antenna system for an aircraft for use with a global positioning system comprising:

an aircraft having an aircraft attitude determination system providing attitude data relating to aircraft roll;

a processor receiving an input originating from the aircraft attitude determination system and providing a drive signal;

a controller receiving the drive signal from the processor;

an articulator driven by the controller; and antenna attached to the articulator driven by the controller oppositely to the aircraft roll.

11. The antenna system of claim 10 wherein the processor provides a dead zone wherein a change in aircraft roll of less than about five degrees does not result in movement of the antenna.

12. The antenna system of claim 10 wherein the aircraft attitude determination system is an inertial navigation system.

13. The antenna system of claim 10 wherein the articulator is contained in a mount on the exterior portion of the aircraft and a radome surrounds the antenna.

14. The antenna system of claim 10 wherein the articulator further comprises a linear motor.

15. The antenna system of claim 10 wherein the aircraft is maintained substantially vertical at least up to about 45 degrees of aircraft roll.

16. The antenna system of claim 15 wherein the antenna is maintained vertically.

17. An antenna system for an aircraft for use with a global positioning system comprising:

an aircraft having an aircraft attitude determination system sensing attitude data relating to aircraft roll;

a translation module connected to the aircraft attitude determination system receiving the attitude data and outputting output data;

a processor receiving the output data from the translation module and providing a drive signal;

a controller receiving the drive signal from the processor;

an articulator driven by the controller; and antenna attached to the articulator driven by the controller oppositely to the aircraft roll.

18. The antenna system of claim 17 wherein the articulator is contained in a mount on the exterior portion of the aircraft and a radome surrounds the antenna.

19. The antenna system of claim 17 wherein the antenna is maintained substantially at least up to about 45 degrees of roll of the aircraft.

20. The antenna system of claim 19 wherein the antenna is maintained vertically relative to the roll of the aircraft.

* * * * *